US009003799B2

(12) United States Patent
Ganti et al.

(10) Patent No.: US 9,003,799 B2
(45) Date of Patent: Apr. 14, 2015

(54) THERMODYNAMIC CYCLE OPTIMIZATION FOR A STEAM TURBINE CYCLE

(75) Inventors: Sanyaswara Rao Ganti, Bangalore (IN); Rajasekar Natarajan, Bangalore (IN); Rakesh Alamsetty, Bangalore (IN)

(73) Assignee: General Electric Company, Schenectady, NY (US)

( * ) Notice: Subject to any disclaimer, the term of this patent is extended or adjusted under 35 U.S.C. 154(b) by 408 days.

(21) Appl. No.: 13/599,833

(22) Filed: Aug. 30, 2012

(65) Prior Publication Data

US 2014/0060054 A1 Mar. 6, 2014

(51) Int. Cl.

*F01K 23/02* (2006.01)
*F01K 13/00* (2006.01)
*F01K 27/02* (2006.01)

(52) U.S. Cl.

CPC ..... *F01K 27/02* (2013.01)

(58) Field of Classification Search

CPC ..... F01K 7/34; F01K 7/40; F01K 7/44; F01K 9/04; F01K 17/04; F01K 17/06; F01K 19/10; F01K 27/02
USPC ..... 60/653, 662, 663, 677–679, 684
See application file for complete search history.

(56) References Cited

U.S. PATENT DOCUMENTS 3,003,321 A * 10/1961 Warth ..... 60/688
3,062,553 A * 11/1962 Juzi ..... 277/304
3,390,525 A * 7/1968 Spillmann ..... 376/310
3,537,265 A * 11/1970 Brown ..... 60/657
3,604,206 A * 9/1971 Baily ..... 60/644.1
3,705,494 A * 12/1972 Bow et al. ..... 60/645
3,906,730 A * 9/1975 Bellati et al. ..... 60/657
3,935,710 A * 2/1976 Dickinson ..... 60/657
4,282,708 A * 8/1981 Kuribayashi et al. ..... 60/778
4,362,013 A * 12/1982 Kuribayashi ..... 60/772
4,517,804 A * 5/1985 Ura et al. ..... 60/657
4,541,247 A * 9/1985 Martin ..... 60/660
4,589,256 A * 5/1986 Akiba et al. ..... 60/660
4,613,952 A * 9/1986 McClanahan ..... 703/6
4,793,141 A * 12/1988 Yanai et al. ..... 60/657
4,873,829 A * 10/1989 Williamson ..... 60/670
5,095,706 A * 3/1992 Saito et al. ..... 60/646
5,388,411 A * 2/1995 McKeever et al. ..... 60/646
5,412,936 A * 5/1995 Lee et al. ..... 60/801

(Continued)

FOREIGN PATENT DOCUMENTS

GB 877951 A * 9/1961
JP 54047012 A * 4/1979

(Continued)

*Primary Examiner* — Thomas Denion
*Assistant Examiner* — Mickey France
(74) *Attorney, Agent, or Firm* — Nixon & Vanderhye P.C.

(57) ABSTRACT

Heat flow from a steam seal header could be used in a stage, such as a low pressure stage, of a steam turbine. However, the dump steam temperature from the steam seal header can be too high requiring removal of excess heat, typically through attemperation, before the dump steam is provided to the low pressure stage. Attemperation poses reliability and life issues and lowers efficiency. To address such short comings, one or more heat pumps are used to transfer heat from the dump steam to the fluid entering a boiler. This allows the dump steam temperature to be within acceptable limits, and at the same time, increase the temperature of the fluid so that the steam cycle performance is enhanced. Preferably, solid-state heat pumps are used as they are reliable, silent and can be precisely controlled.

20 Claims, 7 Drawing Sheets

(56) References Cited

U.S. PATENT DOCUMENTS

| | | | | |
|---|---|---|---|---|
| 5,577,377 | A * | 11/1996 | Tomlinson | 60/783 |
| 5,857,338 | A * | 1/1999 | Rigal | 60/657 |
| 5,913,812 | A * | 6/1999 | Smith et al. | 60/657 |
| 6,237,543 | B1 * | 5/2001 | Charoton et al. | 122/7 R |
| 6,367,261 | B1 | 4/2002 | Marshall et al. | |
| 6,705,086 | B1 * | 3/2004 | Retzlaff et al. | 60/653 |
| 6,779,347 | B2 | 8/2004 | Kucherov et al. | |
| 6,854,273 | B1 | 2/2005 | Lasley et al. | |
| 7,147,427 | B1 * | 12/2006 | Campbell | 415/1 |
| 7,572,973 | B2 | 8/2009 | Weaver, Jr. et al. | |
| 2003/0159444 | A1 * | 8/2003 | Zimron et al. | 60/650 |
| 2005/0072154 | A1 * | 4/2005 | Frutschi | 60/670 |
| 2005/0196267 | A1 * | 9/2005 | Clifford et al. | 415/1 |
| 2006/0140747 | A1 * | 6/2006 | Vandervort et al. | 415/1 |
| 2006/0207643 | A1 | 9/2006 | Weaver, Jr. et al. | |
| 2007/0201999 | A1 * | 8/2007 | Shibata et al. | 418/210 |
| 2009/0056341 | A1 * | 3/2009 | Sanchez et al. | 60/772 |
| 2010/0008756 | A1 * | 1/2010 | Inomata et al. | 415/14 |
| 2010/0258154 | A1 | 10/2010 | Heremans et al. | |
| 2011/0110760 | A1 * | 5/2011 | Sanchez | 415/1 |
| 2011/0214426 | A1 * | 9/2011 | Mehra et al. | 60/645 |
| 2011/0236177 | A1 * | 9/2011 | Mehra et al. | 415/1 |
| 2011/0314817 | A1 * | 12/2011 | Zheng et al. | 60/661 |
| 2012/0023945 | A1 * | 2/2012 | Ishiguro et al. | 60/646 |
| 2012/0027565 | A1 * | 2/2012 | Maruthamuthu et al. | 415/1 |
| 2012/0137683 | A1 * | 6/2012 | Jurgen et al. | 60/641.8 |
| 2012/0294707 | A1 * | 11/2012 | Hernandez Sanchez et al. | 415/171.1 |
| 2013/0156540 | A1 * | 6/2013 | Donkada et al. | 415/1 |
| 2014/0060054 | A1 * | 3/2014 | Ganti et al. | 60/676 |

FOREIGN PATENT DOCUMENTS

| | | | |
|---|---|---|---|
| JP | 58217707 | A * | 12/1983 |
| JP | 62233405 | A * | 10/1987 |
| JP | 2002256814 | A * | 9/2002 |
| JP | 2010209858 | A * | 9/2010 |
| JP | 2011102581 | A * | 5/2011 |
| SU | 1173047 | A * | 8/1985 |
| SU | 1173049 | A * | 8/1985 |

* cited by examiner

THERMODYNAMIC CYCLE OPTIMIZATION FOR A STEAM TURBINE CYCLE

One or more aspects of the present invention relate to method, apparatus and system for thermodynamic cycle optimization for a steam turbine cycle. In particular, one or more aspects relate to improving thermodynamic cycle performance in steam turbines utilizing excess heat that is normally wasted in conventional steam turbines.

BACKGROUND OF THE INVENTION

Currently, excess heat flow from a steam seal header is dumped to a condenser as illustrated in FIG. 1. This steam can be at a very high temperature—up to 900° F. depending on the throttle and reheat temperature of the unit. This excess heat could be used to produce power by admitting into downstream low pressure stages. However, due to the high, perhaps even excessive mismatch between the dump steam and the low pressure reentry stage temperature, there are many unfavorable mechanical implications.

Hence, before admitting the dump steam into the low pressure stage, the temperature of the dump steam needs to be brought down within acceptable limits. Conventionally, this is achieved through attemperation, mixing with low grade steam, and so on. But such conventional methods can be wasteful in that the heat of the dump steam lost through attemperation is not used for useful work. This reduces the steam turbine cycle efficiency. Also the heat transfer is limited by the sink temperature of the heat exchanger (in the case of feed water heater line). The dump steam cannot be cooled below the feed water heat temperature conventionally without using attemperation.

It would be desirable to utilize the excess heat, and thereby enhance the efficiency of the steam turbine cycle.

BRIEF SUMMARY OF THE INVENTION

An aspect of the present invention relates to a steam turbine that comprises a high pressure turbine stage, a low pressure turbine stage, a steam seal header, a boiler, and a heat pump. The high pressure turbine is fluidly connected to a high pressure steam source to receive a high pressure entry steam from the high pressure steam source. The high pressure turbine stage is structured to convert energy of the high pressure entry steam into mechanical energy and output a high pressure exhaust steam. The low pressure turbine stage is fluidly connected to a low pressure steam source to receive a low pressure entry steam from the low pressure steam source. The low pressure turbine stage is structured to convert energy of the low pressure entry steam into mechanical energy and output a low pressure exhaust steam. The steam seal header is fluidly connected to an output of the high pressure turbine stage and fluidly connected to an input of the low pressure turbine stage. The steam seal header is structured to receive at least a portion of the high pressure exhaust steam from the high pressure turbine stage and output a dump steam to the low pressure turbine stage such that the dump steam comprises the portion of the high pressure exhaust stream. The boiler is fluidly connected to a work fluid source to receive work fluid from the work fluid source. The boiler is structured to generate primary steam by applying heat to the work fluid. The heat pump is fluidly located in between the steam seal header and the low pressure turbine stage, and is also fluidly located in between the work fluid source and the boiler. The heat pump is structured to transfer heat from the dump steam to at least a portion of the work fluid.

The invention will now be described in greater detail in connection with the drawings identified below.

BRIEF DESCRIPTION OF THE DRAWINGS

These and other features of the present invention will be better understood through the following detailed description of example embodiments in conjunction with the accompanying drawings, in which.

DETAILED DESCRIPTION OF THE INVENTION

Novel method, system, and apparatus for thermodynamic cycle optimization for a steam turbine cycle are described. In one aspect, the described method, system, and apparatus utilize heat pumps to transfer the excess heat from a dump steam in a useful manner. For example, the heat from the dump steam can be transferred to an exiting feed water heater flow and/or to leak-off flows from pressure packing and valve stems. In this way, the mismatch between the dump steam and the reentry steam temperature at a header of a steam turbine stage can be brought within acceptable limits.

Typically, the pressure difference between a seal steam header (SSH) and a low pressure (LP) turbine stage is the main factor in driving the flow. Thus, in many instances, the dump steam will be provided to the header of the low pressure turbine stage. The dump steam may be provided to the header of any turbine stage where there is an availability of suitably high pressure steam and provisions on the shell at the required sections in the steam turbine.

Figure 2:
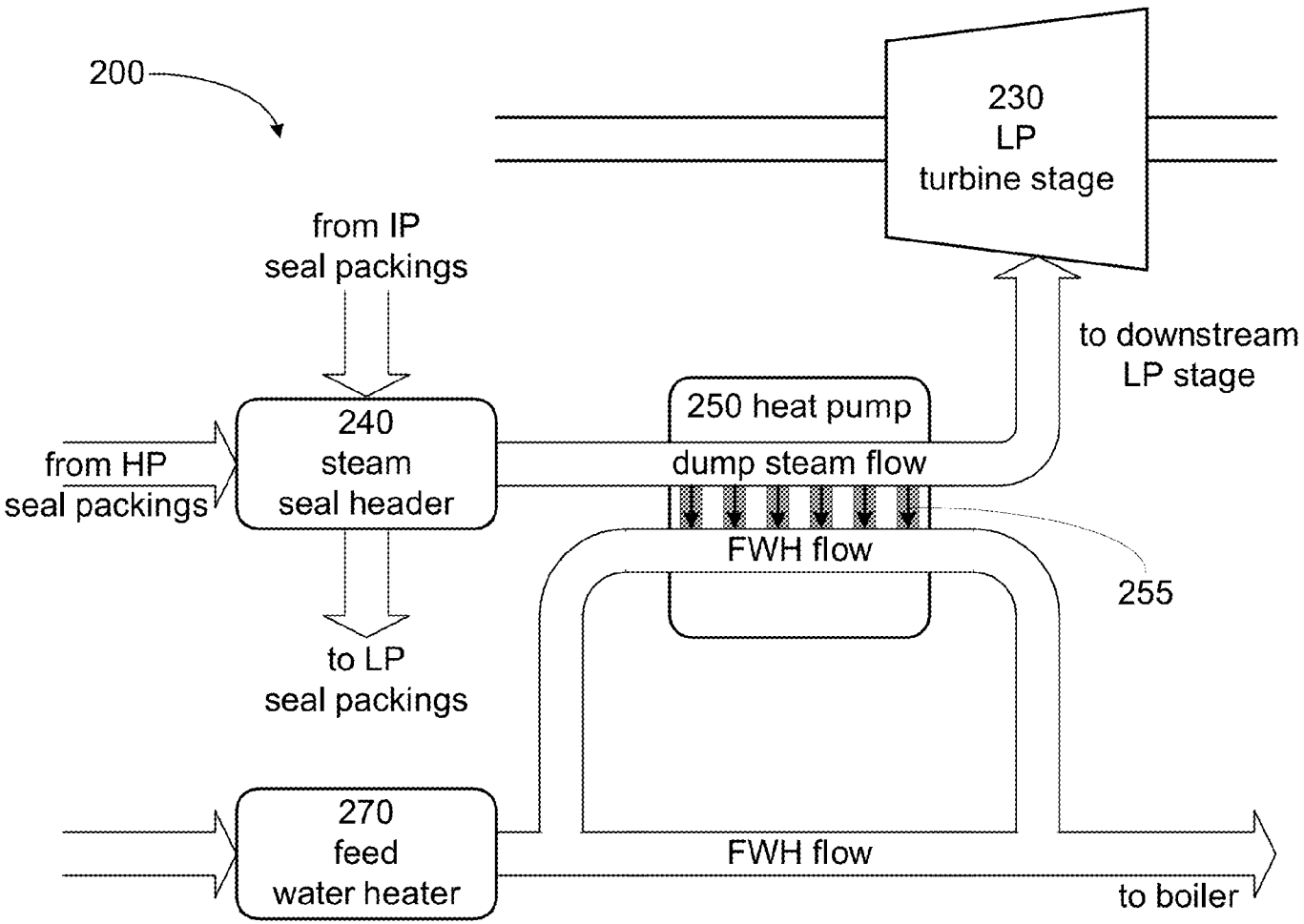
FIG. 2 illustrates an example flow of excess heat in which the excess heat is used in a useful manner.

FIG. 2 illustrates an example flow of excess heat in which the excess heat can be used in a useful manner according to an aspect of the present invention. As seen in this figure, the steam seal header 240 can be fluidly connected to an output of a high pressure (HP) turbine stage. Fluid connection can be achieved in a variety of ways including pipes, valves, and other conduits. Through this fluid connection, the steam seal header 240 can receive exhaust steam, or at least a portion thereof, from a high pressure turbine stage seal packing. The steam seal header 240 can output some, none or all of this high pressure exhaust steam as dump steam, and output any remaining portion to the low pressure turbine stage seal packing. Whenever there is at least some high pressure exhaust steam output as the dump steam, it can be said that the dump steam comprises a portion of the high pressure exhaust steam.

If there is another source of dump steam such as an intermediate pressure (IP) turbine stage, the steam seal header 240 can be fluidly connected to an output of the intermediate pressure turbine stage to receive intermediate pressure exhaust steam, or at least a portion thereof, from the intermediate pressure turbine stage seal packing. In this instance, the dump steam can comprise a portion of the high pressure exhaust steam and/or a portion of the intermediate pressure exhaust steam.

Note that the terms low pressure and high pressure should be interpreted in a relative sense and not in an absolute sense. For example, low pressure turbine stage is not limited to the lowest pressure turbine stage. The phrase "low pressure turbine stage" simply indicates that relative to a high pressure turbine stage or an intermediate pressure turbine stage, the low pressure turbine stage works with lower pressure steam. In one aspect, the pressure of the steam entering the low pressure turbine stage (low pressure entry steam) is lower than the pressure of the steam entering the high pressure turbine stage (high pressure entry steam) or the pressure of the steam entering the intermediate pressure turbine stage (intermediate pressure entry steam). Similarly, high pressure turbine stage does not necessarily refer to a highest pressure turbine.

Figure 1:
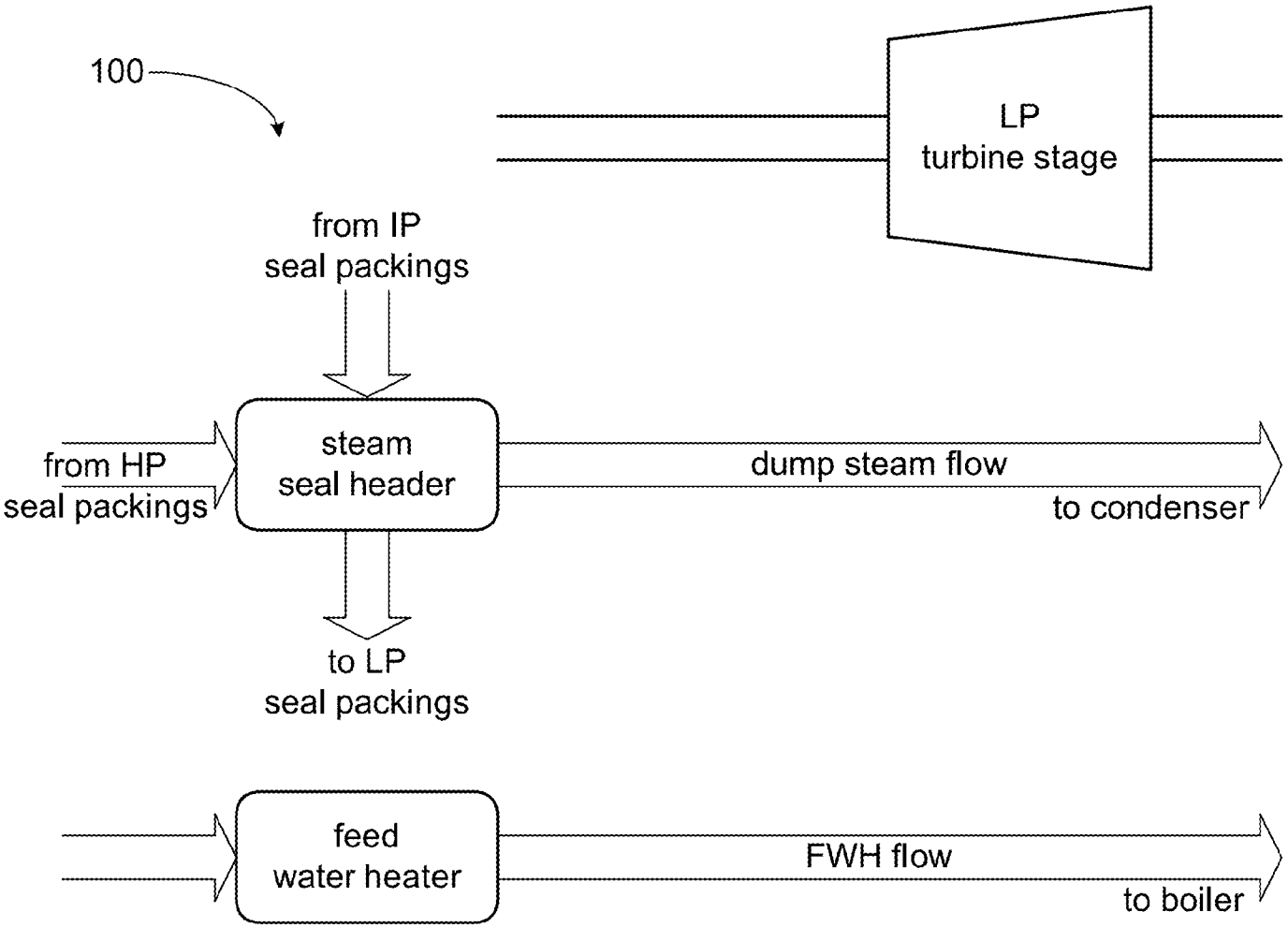
FIG. 1 illustrates flow of excess heat in a conventional steam turbine system.

Unlike the conventional system illustrated in FIG. 1, the steam seal header 240 can be fluidly connected to an input of the low pressure turbine stage 230 such that the steam seal header 240 can provide the dump steam to the low pressure turbine stage 230 instead of to the condenser. Recall the temperature of the dump steam from the steam seal header 240 can be very high—much too high for the low pressure turbine stage 230. To address this short coming of the conventional steam turbine system, in one aspect, a heat pump 250 can be fluidly located in between the dump steam output of the steam seal header 240 and the header input of the low pressure stage turbine 230. The heat pump 250 can extract heat from the dump steam such that the temperature of the dump steam entering the low pressure turbine stage 230 is within acceptable temperature limits of the low pressure turbine stage 230.

One way to extract the heat from the dump steam is to transfer the heat to work fluid flowing to a boiler. In the FIG. 2 example, the work fluid, in the form of feed water, flows from a work fluid source through a feed water heater (FWH) 270 to the boiler. The FWH 270, which can be fluidly located in between work fluid source and the boiler, can preheat the work fluid to output the preheated work fluid.

Note that while some of the preheated work fluid can bypass the heat pump 250, at least some can also flow through the heat pump 250. That is, in addition to being fluidly located in between the steam seal header 240 and the low pressure turbine stage 230, the heat pump 250 can be fluidly located in between the FWH 270 and the boiler such that at least a portion of the preheated work fluid flows through the heat pump 250. The heat pump 250 can transfer the heat from the dump steam to the portion of the work fluid flowing through it to reduce the temperature of the dump steam entering the low pressure stage 230. Preferably, the temperature of the dump steam is sufficiently reduced to be within acceptable temperature limits.

By using the heat pump 250 to transfer heat from the dump steam to the work fluid, additional work can be extracted from the dump steam. Also, greater thermodynamic efficiency can be gained by further heating the work fluid entering the boiler 480.

In an aspect, the heat pump 250 can include one or several heat transfer devices 255. The arrows on the heat transfer devices 255 indicate the direction of heat transfer. Preferably, the heat transfer devices 255 are solid state heat transfer devices. Examples of solid state heat transfer devices include thermoelectric devices, thermionic devices, and thermoelectric-thermionic combination devices. The heat transfer devices 255 can be used as heat pumps via the peltier effect.

While not illustrated, it is fully contemplated that one or more flow control mechanisms can be put in place, such as controllable valves, fluid pumps, etc. so as to control flow rates of any of the dump steam flow, the work fluid flow within the heat pump 250, and the work fluid flow that bypasses the heat pump 250. It is also contemplated that the electrical power applied to the solid state heat transfer devices 255 can be controlled. In this way, rate of heat transfer from the dump steam to the work fluid can be controlled as well.

In FIG. 2, the direction of heat transfer in the heat pump 250 is shown to be from the dump steam to the work fluid. In most circumstances, this will be the direction. But it should be noted that the heat pump 250 itself is not so limited. The direction of the heat transfer can also be controlled through controlling the direction of the current of the electrical power applied to the solid state heat transfer devices 255. Thus, while it is unlikely, the heat pump 250 can be controlled to transfer heat from the work fluid to the dump steam if that becomes necessary.

Also in FIG. 2, the steam seal header 240 is shown to receive inputs from two sources of the dump steam—the high pressure turbine stage and the intermediate pressure turbine stage. This is merely an example and should not be taken to be limiting. The number of sources for the dump steam can be one or any number greater than one. Also, only output one dump steam flow illustrated from the steam seal header 240. Again, this should not be taken to be limiting. The steam seal header 240 can output multiple dump steam flows flowing to different downstream turbine stages. Further, the feed water heater 270 is not strictly necessary. That is, the heat pump 250 can transfer heat from the dump steam to the work fluid that has not been preheated.

Figure 3:
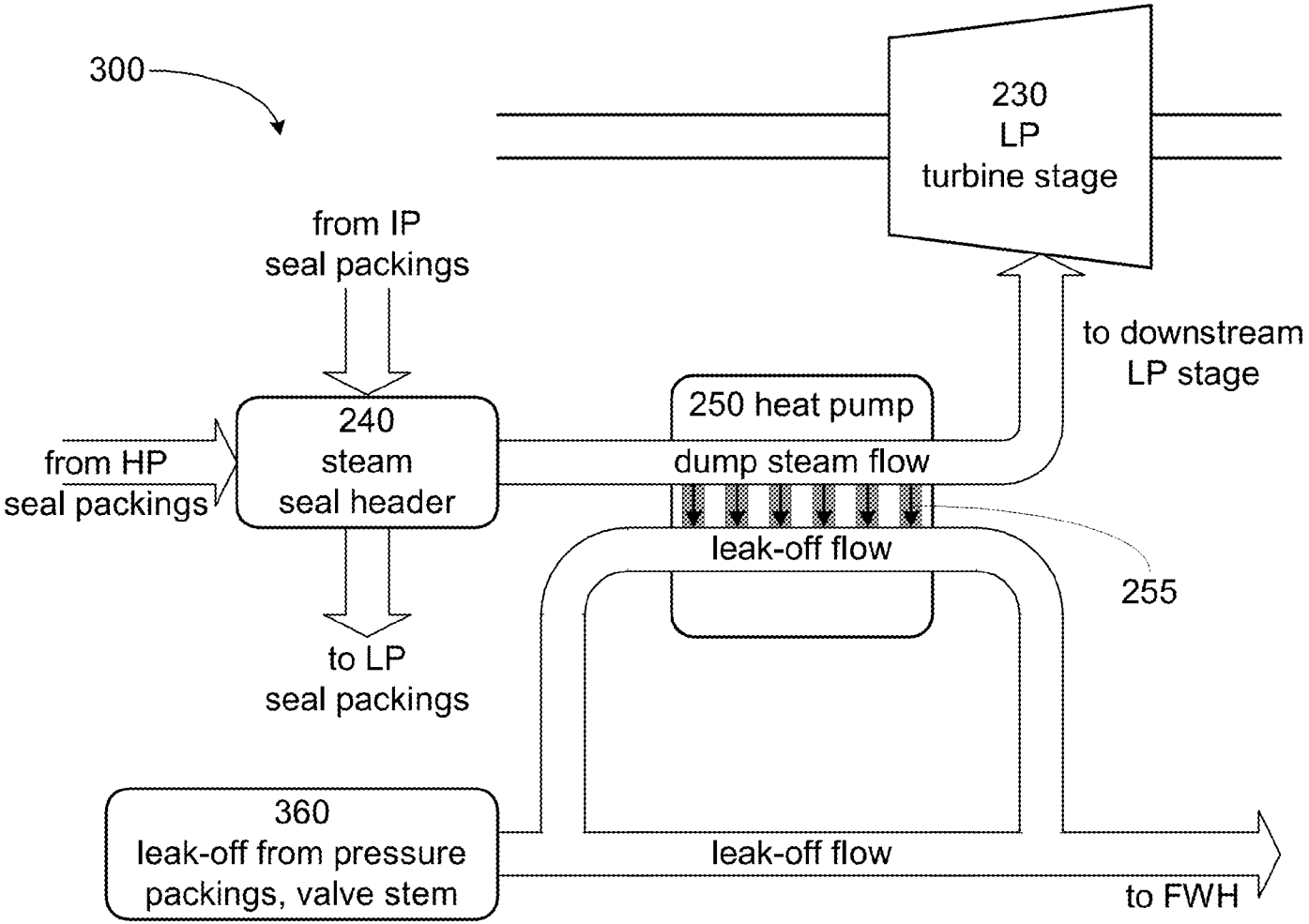
FIG. 3 illustrates another example flow of excess heat in which the excess heat is used in a useful manner.

FIG. 3 illustrates an example flow of excess heat in which the excess heat can be used in a useful manner according to another aspect of the present invention. FIG. 3 is similar to FIG. 2 in many respects. For example, the steam seal header 240 can be fluidly connected one or both output of the high and intermediate pressure turbine stages. The heat pump 250 can be fluidly located in between the steam seal header 240 and the low pressure turbine stage 230.

But instead of the FWH 270, a leak-off collector 360 is shown. The leak-off collector 360 can collect leak-off steam flows from end packings, from valve stems of one or more turbine stages, or from both. The leak-off collector 360 can output leak-off flow to the FWH 270 (not shown in FIG. 3). Thus, the leak-off flow can be considered as work fluid and the leak-off collector 360 can be viewed as an example of a work fluid source.

As seen in FIG. 3, the heat pump 250 can be fluidly located in between leak-off collector 360 and FWH. More generally, the heat pump 250 can be fluidly located in between a work fluid source and the boiler. The heat pump 250 can transfer the heat from the dump steam to the portion of the leak-off flow flowing though the heat pump 250. Again, it is preferable that the temperature of the dump steam is sufficiently reduced to be within acceptable temperature limits of the low pressure turbine stage 230.

Figure 4:
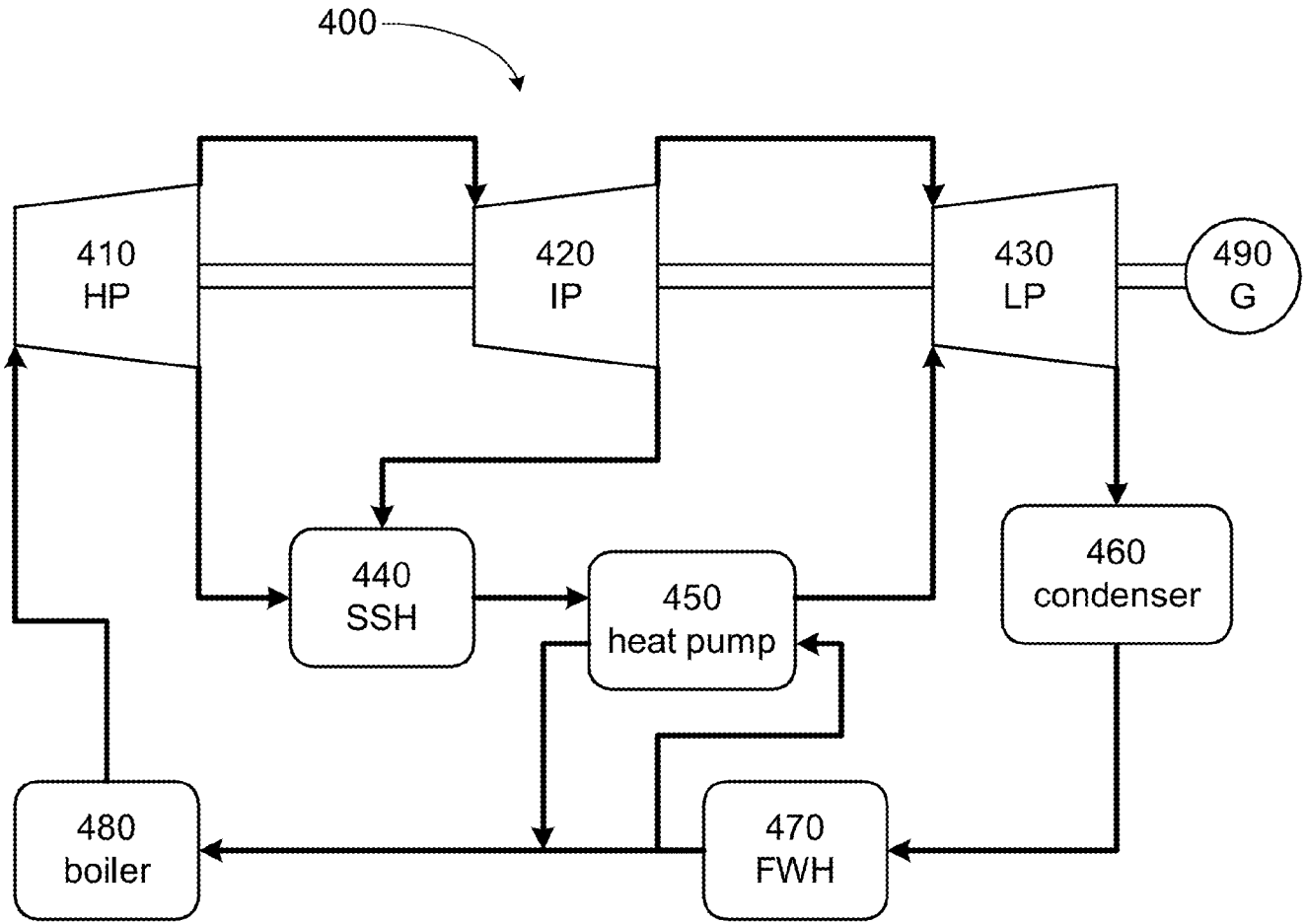
FIG. 4 illustrates an architecture of a steam turbine system according to an embodiment of the present invention.

FIG. 4 illustrates an architecture of a steam turbine system 400 according to an embodiment of the present invention. The system 400 can include multiple turbine stages. In FIG. 4, the multiple stages comprise a high pressure turbine stage 410, an intermediate pressure turbine stage 420, and a low pressure turbine stage 430. This is an example and should not be taken to be limiting. The described aspects can be applicable to a steam turbine system with as few as two stages or more than three.

Figure 7:
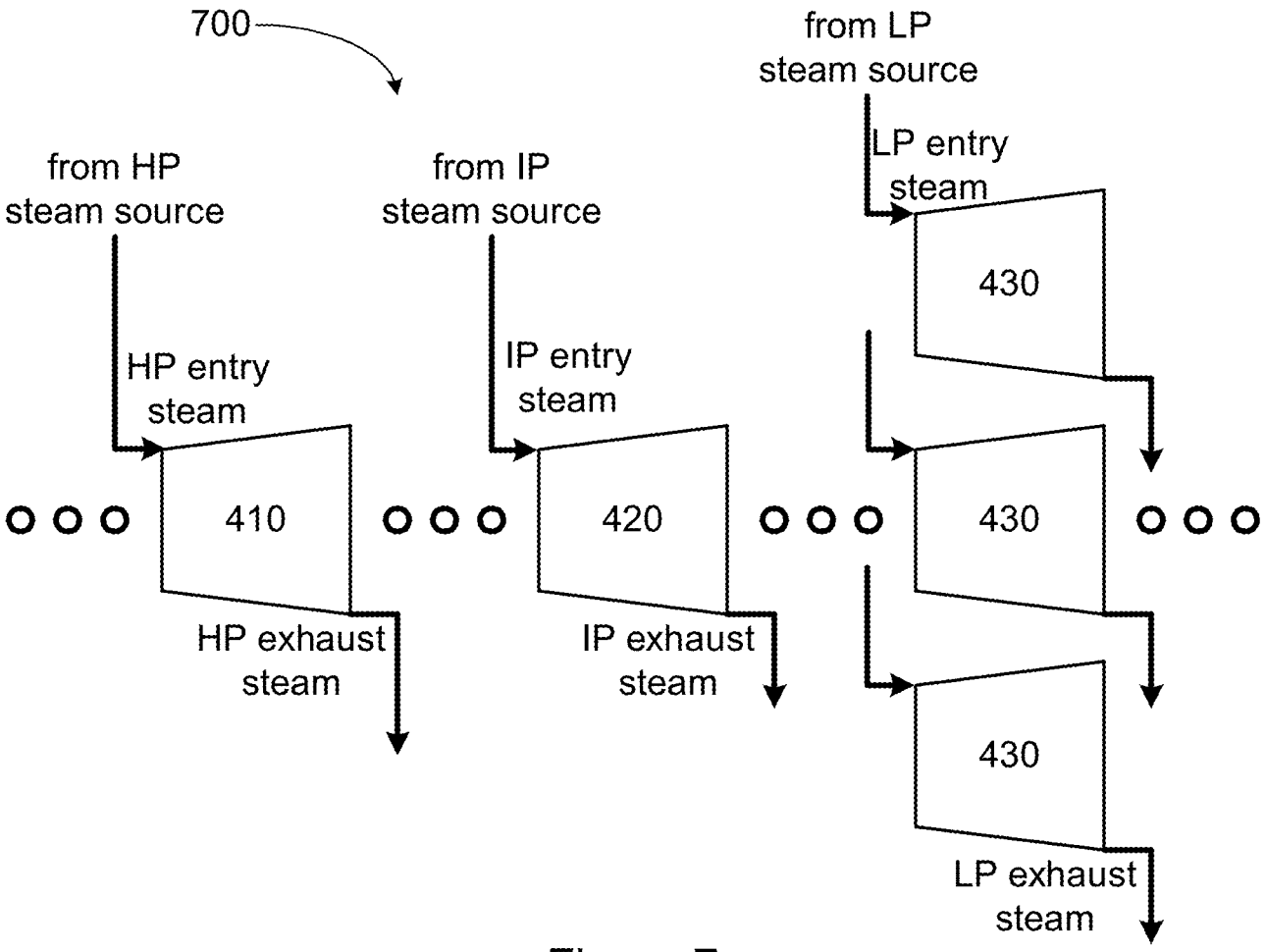
FIG. 7 illustrates an example configuration of steam turbine stages according to an embodiment of the present invention.

For explanation, the reader's attention is directed to FIG. 7 which illustrates an example configuration of steam turbine stages. The configuration 700 can include multiple turbine stages. In each stage, the turbine of that stage can receive an entry steam from a steam source (fluidic connection to the steam source not shown), converts the energy of the entry steam into mechanical energy, and output an exhaust steam. For example, the high pressure turbine stage 410 can receive a high pressure entry steam from a high pressure steam source, convert the energy of the high pressure entry steam into mechanical energy and output a high pressure exhaust steam. Similarly, the intermediate and low pressure turbine stages 420, 430 can receive intermediate and low pressure entry steams from their respective sources, convert the energy of the intermediate and low pressure entry steams, and output intermediate and low pressure exhaust steams.

In one aspect, the stages are differentiated by the pressure of the entry steams. That is, the pressure of the high pressure entry steam is higher than that of the intermediate pressure entry steam, which is higher than that of the low pressure entry steam. Recall that "high pressure", "intermediate pressure" and "low pressure" should be interpreted in a relative sense. FIG. 7 shows this more clearly. As seen, there can be even a higher pressure turbine stage than the high pressure turbine stage 410. Similarly, there can be even a lower pressure turbine stage than the low pressure turbine stage 430. But among the high, intermediate, and low pressure turbine stages 410, 420, 430, there can be a relative ordering of the entry pressures.

Further, the high, intermediate, and low pressure turbine stages 410, 420, 430 need not be consecutive. That is, there can be intervening stages between the high and intermediate pressure stages 410, 420 or between the intermediate and low pressure stages 420, 430. Yet further, the number of stages at a particular pressure is not limited to one. For example, FIG. 7 illustrates three low pressure turbine stages 430. While not shown in this figure, the dump steam can be provided to any one of these stages.

Referring back to FIG. 4, the system 400 can include a generator 490 which converts the mechanical energy of the turbine stages into electricity. The system 400 can also include a steam seal header 440, a heat pump 450, a condenser 460, a FWH 470, and a boiler 480. The condenser 460 can be fluidly connected to an output of the low pressure turbine stage 430 and condense the low pressure exhaust steam. The condensed steam can be provided as work fluid to the boiler 480, which can generate primary steam by applying heat to the work fluid. Thus, the condenser 460 can be considered as being work fluid source. The specifics of the steam seal header 440, the heat pump 450, and the FWH 470 have been described above with respect to FIGS. 2 and 3, and therefore will not be repeated.

As seen in FIG. 4, the steam seal header 440 can be fluidly connected to an output of the high pressure turbine stage 410 and to an input of the low pressure turbine stage 430. The steam seal header 440 can receive at least a portion of the high pressure exhaust steam and output the dump steam to the low pressure turbine stage 430. The dump steam thus can comprise a portion of the high pressure exhaust stream.

As indicated above, the aspects described in this disclosure can be applied to a steam turbine system two stages. Thus, the intermediate pressure turbine stage 420 is not strictly necessary. However, when the system 400 does include the intermediate pressure turbine stage 420, the steam seal header 440 can also be fluidly connected to an output of the intermediate pressure turbine stage 420 to receive at least a portion of the intermediate pressure exhaust steam such that the dump steam also comprises a portion of the intermediate pressure exhaust stream.

The heat pump 450 can be fluidly located in between the steam seal header 440 and the low pressure turbine stage 430 and in between the work fluid source, e.g. the condenser 460, and the boiler 480. In this instance, the heat pump 450 can transfer heat from the dump steam to at least a portion of the work fluid.

The system 400 can also include a FWH 470, which can be fluidly located in between the work fluid source and the boiler 480, and the heat pump 450 can be fluidly located in between the FWH 470 and the boiler 480. In this instance, the heat pump 450 can transfer heat from the dump steam to at least a portion of the preheated work fluid.

Note that in FIG. 4, the high pressure entry steam is the primary steam from the boiler 480, the intermediate entry steam is the high pressure exhaust steam from the high pressure turbine stage 410, and the low pressure entry steam is the intermediate pressure exhaust steam from the intermediate pressure turbine stage 420. In other words, the high pressure, intermediate pressure, and low pressure steam sources can respectively be the boiler 480, the high pressure turbine stage 410, and the intermediate pressure turbine stage 420. Again, this is a specific example and should not be taken to be limiting.

Figure 5:
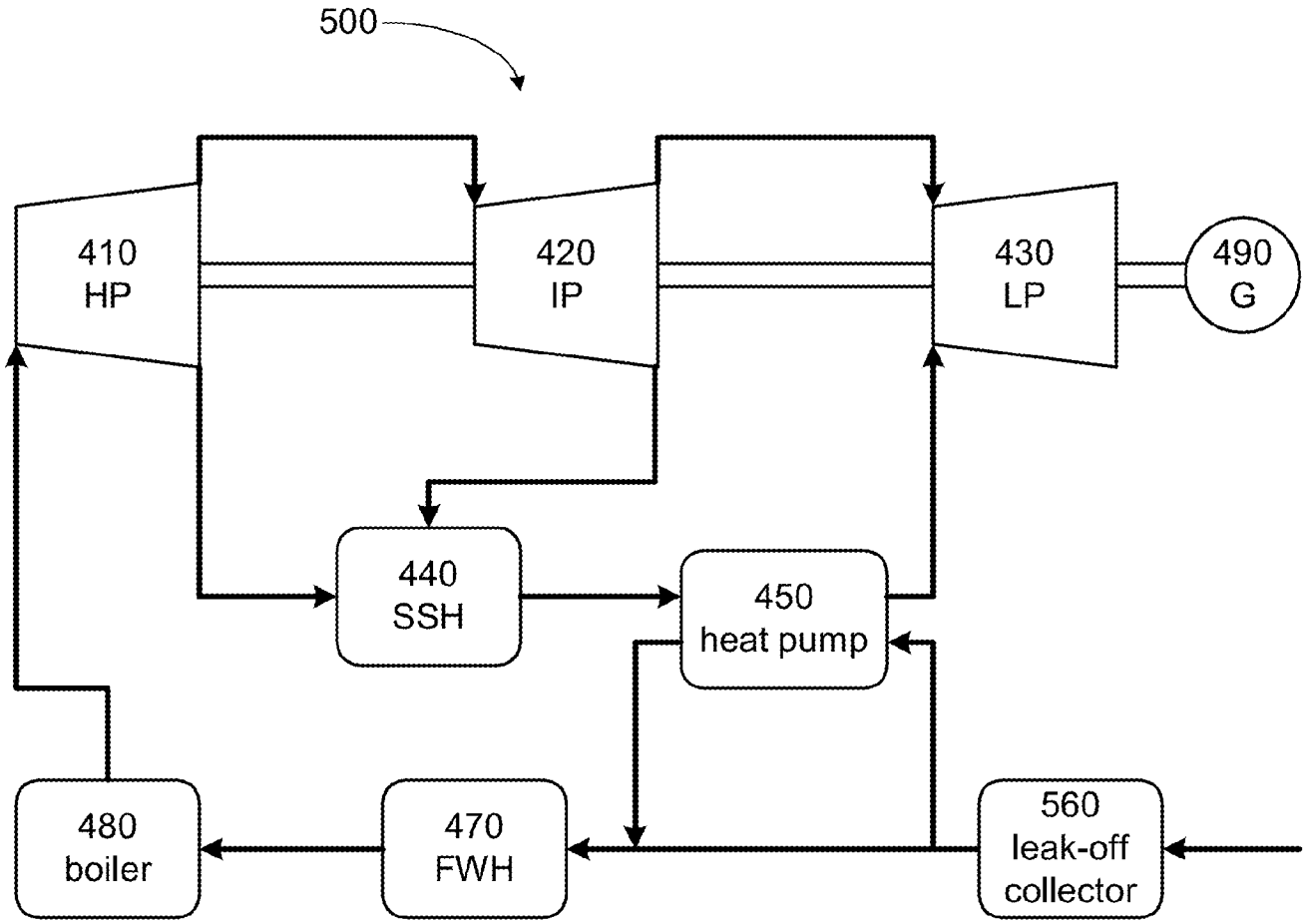
FIG. 5 illustrates an architecture of a steam turbine system according to another embodiment of the present invention.

FIG. 5 illustrates an architecture of a steam turbine system according to another embodiment of the present invention. The system 500 illustrated in FIG. 5 is similar in many respects to the system 400 illustrated in FIG. 4. Therefore, only those details that are particular to this embodiment will be described.

In this embodiment, the leak-off collector 560 can be a work fluid source. Thus, the heat pump 450 can be fluidly located in between the work fluid source, e.g., the leak-off collector 560, and the boiler 480, and can transfer heat from the dump steam to the work fluid. The dump steam can comprise a portion of the high pressure exhaust steam from the high pressure turbine stage 410. When the system 500 also includes the intermediate pressure turbine stage, the dump steam can include a portion of the intermediate pressure exhaust steam as well. Like FIG. 4, the system 500 can include the FWH 470. But in this instance, the heat pump 450 can be fluidly located in between the leak-off collector 560 and the FWH 470.

Figure 6:
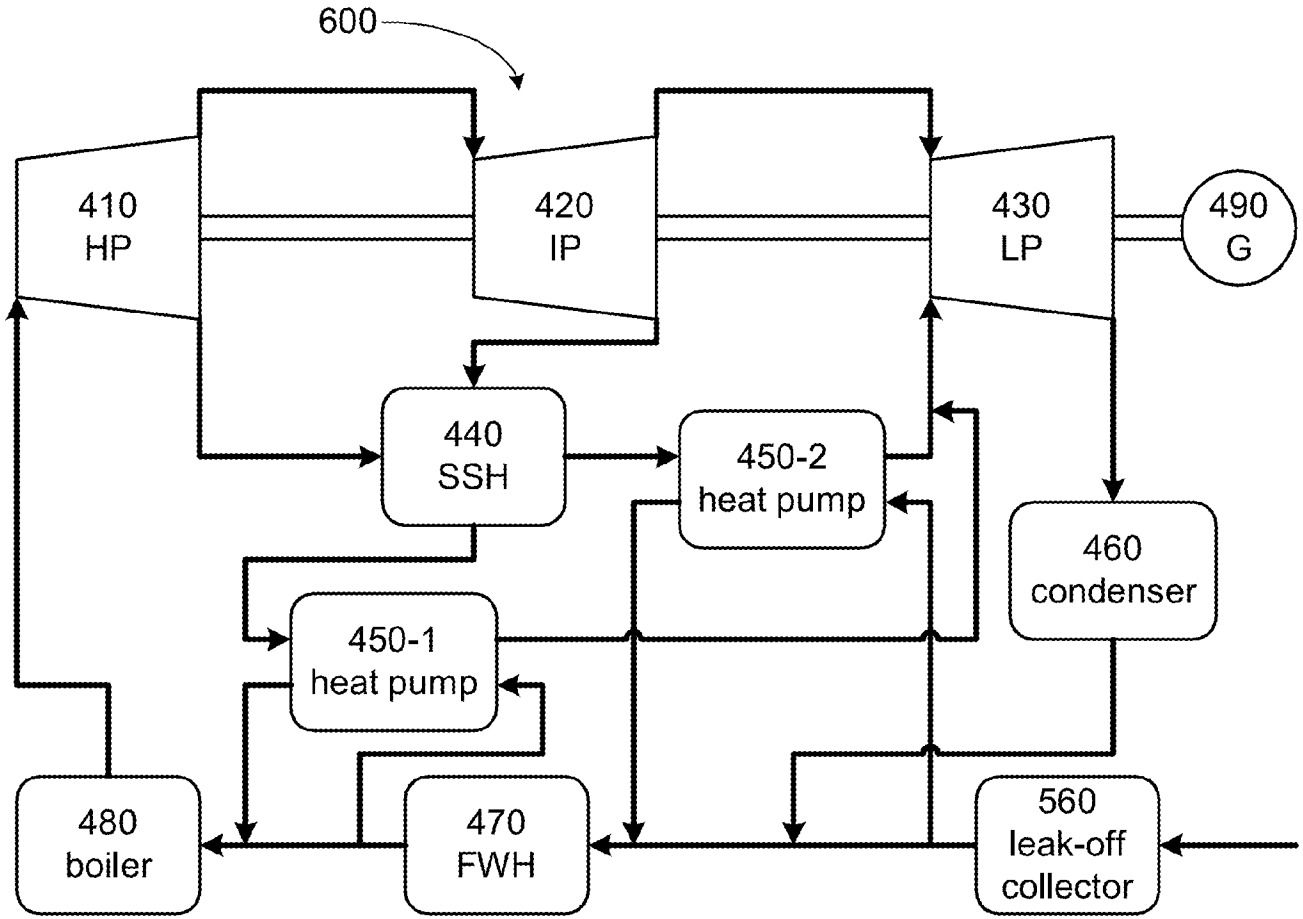
FIG. 6 illustrates an architecture of a steam turbine system according to yet another embodiment of the present invention.

Of course, the embodiments may be combined as illustrated in FIG. 6. In this figure, the system 600 includes two heat pumps—first and second heat pumps 450-1, 450-2. The first heat pump 450-1 is similar to the heat pump 450 of system 400 in FIG. 4, and the second heat pump 450-2 is similar to the heat pump 450 of system 500 in FIG. 5. The details of the individual components of system 600 will be omitted since they have been described previously.

The disclosed aspects are applicable to turbine systems other than the specific examples described thus far. The number of steam seal headers and heat pumps are not limited. Also, excess heat from any exhaust flow that would not be utilized in the conventional system can be converted for useful purposes in light of the disclosed aspects.

There are numerous advantages associated with the disclosed aspects. Among them are:

- SSH flow which, instead of dumping into the condenser, can be used for power extraction;
- Admission of the SSH flow can be accomplished to reduce the temperature mismatch of the low pressure turbine stage without attemperation, and thus save on costs and reduce unfavorable effects on the system performance;

Effective control of the temperature of the steam entering the low pressure turbine stage through regulating the electrical power to the solid state heat transfer devices;

Flexibility to meet specific requirements afforded due to modular construction of the heat transfer devices, and Easy integration with existing control systems.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A steam turbine, comprising:

a high pressure turbine stage fluidly connected to a high pressure steam source to receive a high pressure entry steam from the high pressure steam source, the high pressure turbine stage being structured to convert energy of the high pressure entry steam into mechanical energy and output a high pressure exhaust steam;

a low pressure turbine stage fluidly connected to a low pressure steam source to receive a low pressure entry steam from the low pressure steam source, the low pressure turbine stage being structured to convert energy of the low pressure entry steam into mechanical energy and output a low pressure exhaust steam;

a steam seal header fluidly connected to an output of the high pressure turbine stage and fluidly connected to an input of the low pressure turbine stage, the steam seal header being structured to receive at least a portion of the high pressure exhaust steam from the high pressure turbine stage and output a dump steam to the low pressure turbine stage, the dump steam comprising the portion of the high pressure exhaust stream;

a boiler fluidly connected to a work fluid source to receive work fluid provided by the work fluid source, the boiler being structured to generate primary steam by applying heat to the work fluid; and a heat pump fluidly located in between the steam seal header and the low pressure turbine stage and in between the work fluid source and the boiler, the heat pump being structured to transfer heat from the dump steam to at least a portion of the work fluid.

2. The steam turbine of claim 1, wherein the heat pump is structured to transfer the heat from the dump steam to the portion of the work fluid such that a temperature of the dump steam entering the low pressure turbine stage is within acceptable temperature limits of the low pressure turbine stage.

3. The steam turbine of claim 1, wherein the heat pump comprises one or more solid-state heat transfer devices.

4. The steam turbine of claim 3, wherein at least one solid-state heat transfer device is a thermoelectric device, a thermionic device, or a thermoelectric-thermionic combination device.

5. The steam turbine of claim 1, further comprising an intermediate pressure turbine stage fluidly connected to an intermediate pressure steam source to receive an intermediate pressure entry steam from the intermediate pressure steam source, the intermediate pressure turbine stage being structured to convert energy of the intermediate pressure entry steam into mechanical energy and output an intermediate pressure exhaust steam, wherein the steam seal header is also fluidly connected to an output of the intermediate pressure turbine stage, the steam seal header being structured to receive at least a portion of the intermediate pressure exhaust steam from the intermediate pressure turbine stage such that the dump steam also comprises the portion of the intermediate pressure exhaust stream.

6. The steam turbine of claim 5, wherein the high pressure entry steam is the primary steam from the boiler, the intermediate entry steam is the high pressure exhaust steam from the high pressure turbine stage, and the low pressure entry steam is the intermediate pressure exhaust steam from the intermediate pressure turbine stage.

7. The steam turbine of claim 1, wherein the work fluid source is a condenser fluidly connected to an output of the low pressure turbine stage, the condenser being structured to condense the low pressure exhaust steam from the low pressure turbine stage and output the condensed steam as the work fluid.

8. The steam turbine of claim 7, further comprising a feed water heater fluidly located in between the condenser and the boiler, the feed water heater being structured to preheat the work fluid from the condenser and output the preheated work fluid, wherein the heat pump is fluidly located in between the feed water heater and the boiler, the heat pump being structured to transfer heat from the dump steam to at least a portion of the preheated work fluid.

9. The steam turbine of claim 8, wherein the heat pump is structured to transfer the heat from the dump steam to the portion of the preheated work fluid such that a temperature of the dump steam entering the low pressure turbine stage is within acceptable temperature limits of the low pressure turbine stage.

10. The steam turbine of claim 8, wherein the heat pump comprises one or more solid-state heat transfer devices.

11. The steam turbine of claim 8, further comprising an intermediate pressure turbine stage fluidly connected to an intermediate pressure steam source to receive an intermediate pressure entry steam from the intermediate pressure steam source, the intermediate pressure turbine stage being structured to convert energy of the intermediate pressure entry steam into mechanical energy and output an intermediate pressure exhaust steam, wherein the steam seal header is also fluidly connected to an output of the intermediate pressure turbine stage, the steam seal header being structured to receive at least a portion of the intermediate pressure exhaust steam from the intermediate pressure turbine stage such that the dump steam also comprises the portion of the intermediate pressure exhaust stream.

12. The steam turbine of claim 1, wherein the work fluid source is a leak-off collector structured to collect a high pressure steam leak from the high pressure turbine stage and output a leak-off fluid as the work fluid.

13. The steam turbine of claim 12, further comprising a feed water heater fluidly located in between the leak-off collector and the boiler, the feed water heater being structured to preheat the leak-off fluid from the leak-off collector and output the preheated leak-off fluid, wherein the heat pump is fluidly located in between the feed water heater and the leak-off collector, the heat pump being structured to transfer heat from the dump steam to at least a portion of the leak-off fluid.

14. The steam turbine of claim 13, wherein the heat pump is structured to transfer the heat from the dump steam to the portion of the leak-off fluid such that a temperature of the dump steam entering the low pressure turbine stage is within acceptable temperature limits of the low pressure turbine stage.

15. The steam turbine of claim 13, wherein the heat pump comprises one or more solid-state heat transfer devices.

16. The steam turbine of claim 13, further comprising an intermediate pressure turbine stage fluidly connected to an intermediate pressure steam source to receive an intermediate pressure entry steam from the intermediate pressure steam source, the intermediate pressure turbine stage being structured to convert energy of the intermediate pressure entry steam into mechanical energy and output an intermediate pressure exhaust steam, wherein the steam seal header is also fluidly connected to an output of the intermediate pressure turbine stage, the steam seal header being structured to receive at least a portion of the intermediate pressure exhaust steam from the intermediate pressure turbine stage such that the dump steam also comprises the portion of the intermediate pressure exhaust stream.

17. The steam turbine of claim 1, further comprising a feed water heater fluidly located in between the work fluid source and the boiler, the feed water heater being structured to preheat the work fluid from the work fluid source and output the preheated work fluid, wherein the heat pump comprises:

a first heat pump fluidly located in between the feed water heater and the boiler, the heat pump being structured to transfer heat from the dump steam to at least a portion of the preheated work fluid; and a second heat pump fluidly located in between the feed water heater and the work fluid source, the second heat pump being structured to transfer heat from the dump steam to at least a portion of the work fluid.

18. The steam turbine of claim 17, wherein the first and second heat pumps are structured to transfer the heat from the dump steam to the leak-off fluid and to the preheated fluid such that a temperature of the dump steam entering the low pressure turbine stage is within acceptable temperature limits of the low pressure turbine stage.

19. The steam turbine of claim 17, wherein one or both of the first and second heat pumps comprise one or more solid-state heat transfer devices.

20. The steam turbine of claim 17, further comprising an intermediate pressure turbine stage fluidly connected to an intermediate pressure steam source to receive an intermediate pressure entry steam from the intermediate pressure steam source, the intermediate pressure turbine stage being structured to convert energy of the intermediate pressure entry steam into mechanical energy and output an intermediate pressure exhaust steam, wherein the steam seal header is also fluidly connected to an output of the intermediate pressure turbine stage, the steam seal header being structured to receive at least a portion of the intermediate pressure exhaust steam from the intermediate pressure turbine stage such that the dump steam also comprises the portion of the intermediate pressure exhaust stream.

* * * * *